US006537126B2

(12) United States Patent
Wagner

(10) Patent No.: US 6,537,126 B2
(45) Date of Patent: Mar. 25, 2003

(54) AMUSEMENT DEVICE

(75) Inventor: Clifford Wagner, Pittsfield, MA (US)

(73) Assignee: Clifford Wagner Science Interactives, Inc., Pittsfield, MA (US)

( * ) Notice: Subject to any disclaimer, the term of this patent is extended or adjusted under 35 U.S.C. 154(b) by 0 days.

(21) Appl. No.: 09/908,358

(22) Filed: Jul. 18, 2001

(65) Prior Publication Data

US 2003/0040248 A1 Feb. 27, 2003

(51) Int. Cl.[7] ..... A63H 1/06; A63H 1/28

(52) U.S. Cl. ..... 446/266; 446/236; 40/472; 226/181

(58) Field of Search ..... 446/486, 236, 446/243, 247, 248, 253, 266, 244, 484, 491, 241; 40/472, 524; 226/181, 188, 97.4

(56) References Cited

U.S. PATENT DOCUMENTS

| | | | | | |
|---|---|---|---|---|---|
| 2,941,332 | A | | 6/1960 | Tracy | 46/202 |
| 3,398,949 | A | | 8/1968 | Young et al. | 272/8 |
| 3,406,967 | A | | 10/1968 | Young et al. | 272/8 |
| 3,491,479 | A | * | 1/1970 | Carter | 446/145 |
| 3,797,163 | A | | 3/1974 | McRoskey et al. | 46/39 |
| 3,904,098 | A | * | 9/1975 | Kupperman et al. | 226/97.4 |
| 3,964,189 | A | | 6/1976 | Belokin, Jr. | 40/33 |
| 4,201,002 | A | * | 5/1980 | Barton | 40/472 |
| 4,266,369 | A | | 5/1981 | Spector | 46/260 |
| 4,432,482 | A | * | 2/1984 | Beausoleil | 225/46 |

* cited by examiner

*Primary Examiner*—Jacob K. Ackun
*Assistant Examiner*—Bena B. Miller
(74) *Attorney, Agent, or Firm*—Howard C. Miskin; Gloria Tsui-Yip

(57) ABSTRACT

An amusement device having an endless flexible strand forming a loop and an inline traction drive unit that drives a portion of the strand to impart inline linear velocity to the strand to create an elongated loop extending from the drive unit. The amusement device includes a housing with a handle and a rotatable cup with an ejection aperture for changing the direction of the driven loop.

14 Claims, 6 Drawing Sheets

AMUSEMENT DEVICE

BACKGROUND OF THE INVENTION

1. Field of the Invention

The device of the present invention relates to hand-held amusements that include a flexible strand 2. Related Art

SUMMARY OF THE INVENTION

An amusement device comprising an endless flexible loop and an inline traction drive unit to rotate the loop.

DESCRIPTION OF THE PREFERRED EMBODIMENTS

Figure 1:
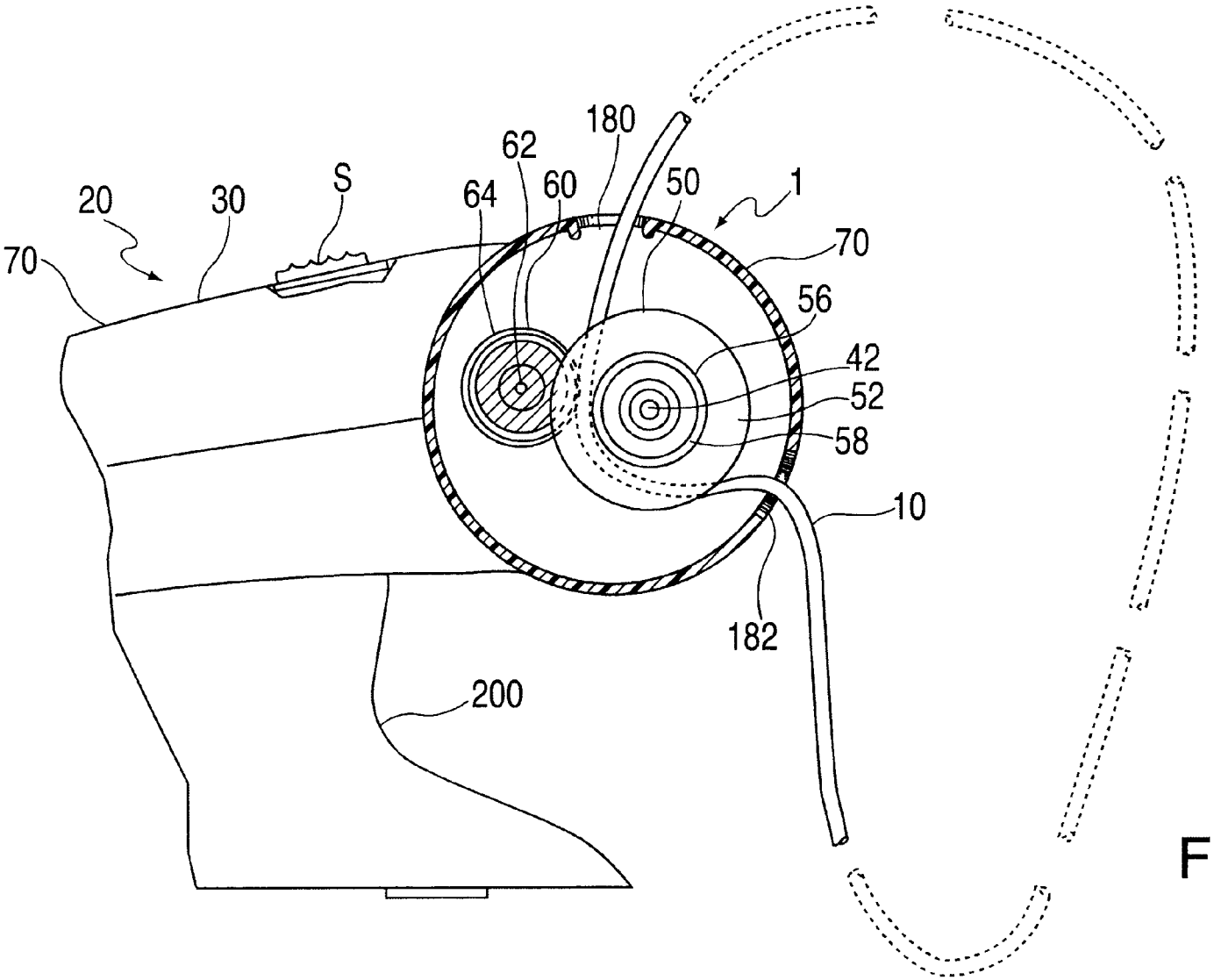
FIG. 1 is a side elevation view, partially in section, of the an amusement device 1 of the present invention.
Figure 2:
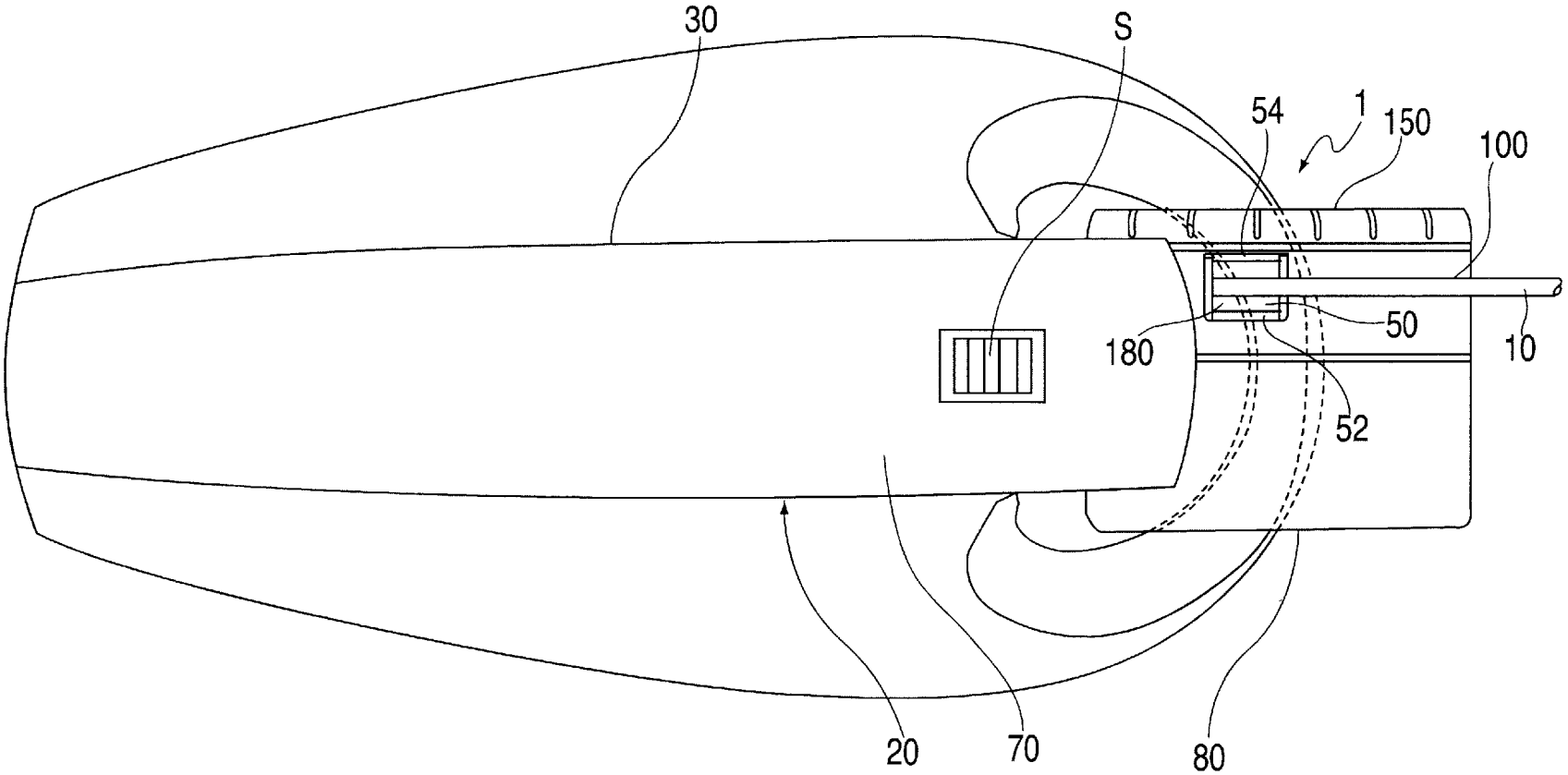
FIG. 2 is a top plan view, partially in phantom, of said amusement device.
Figure 3:
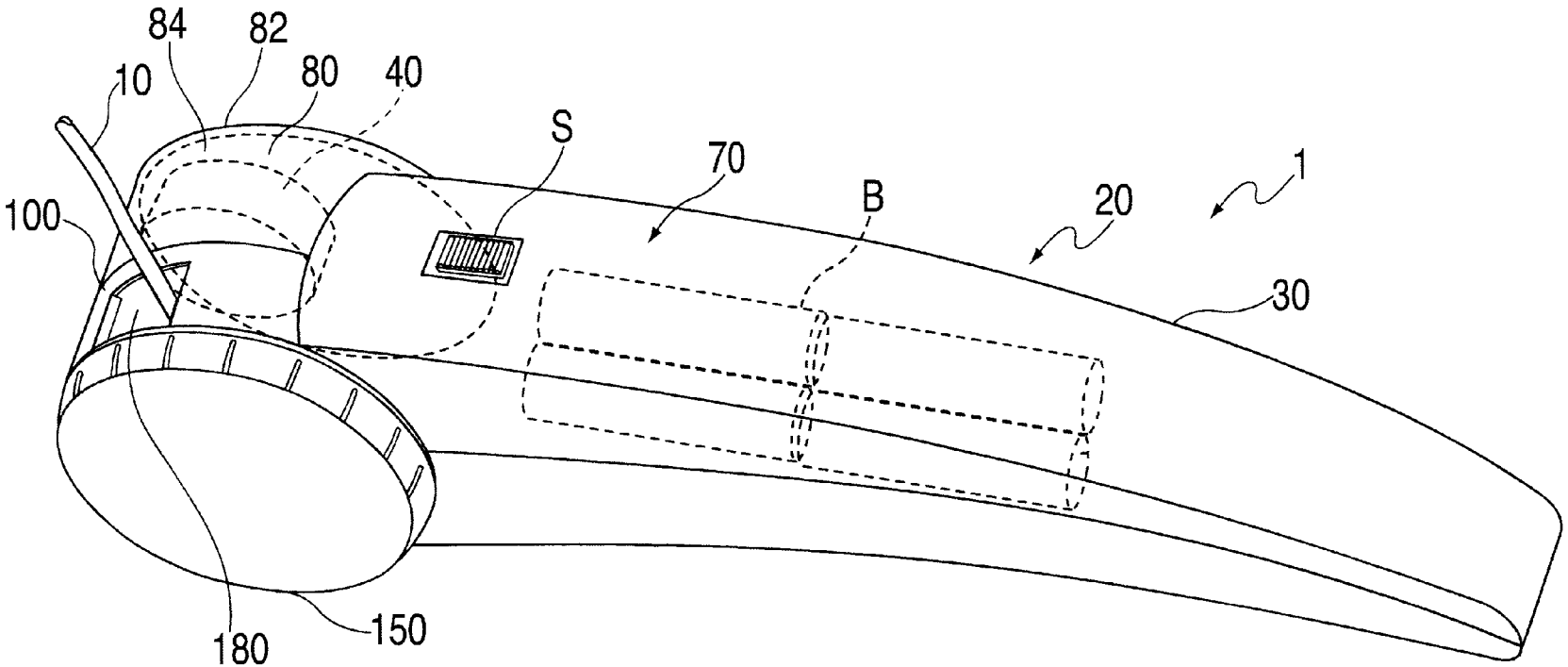
FIG. 3 is a top perspective view of said device.
Figure 4:
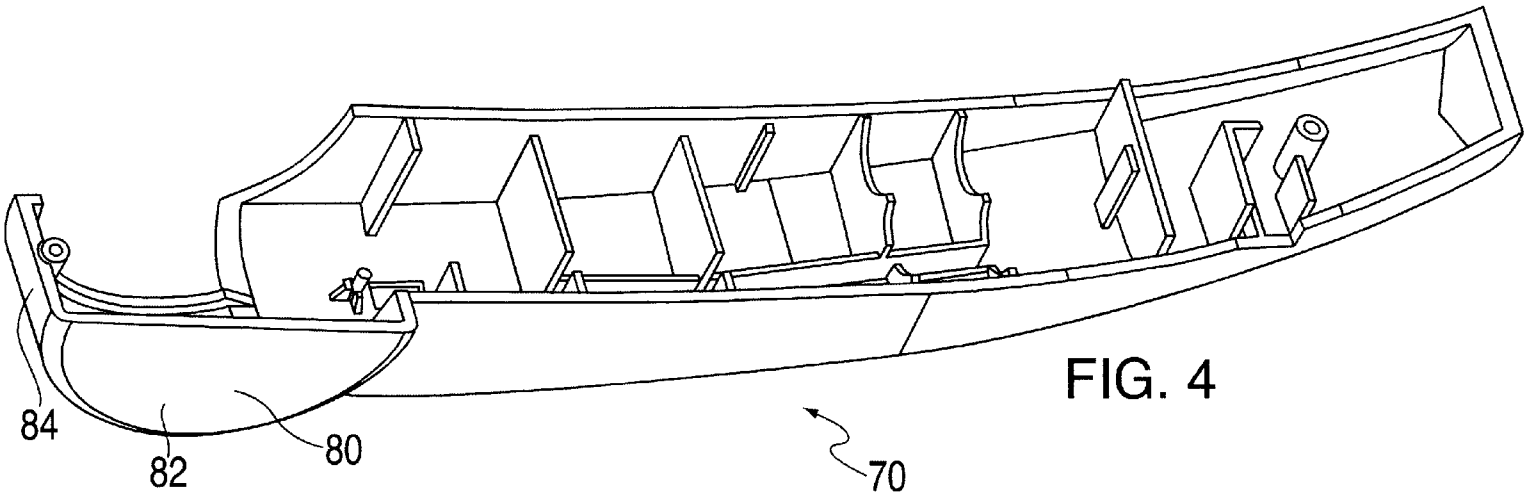
FIG. 4 is a bottom perspective view of a handle of said device.
Figure 5:
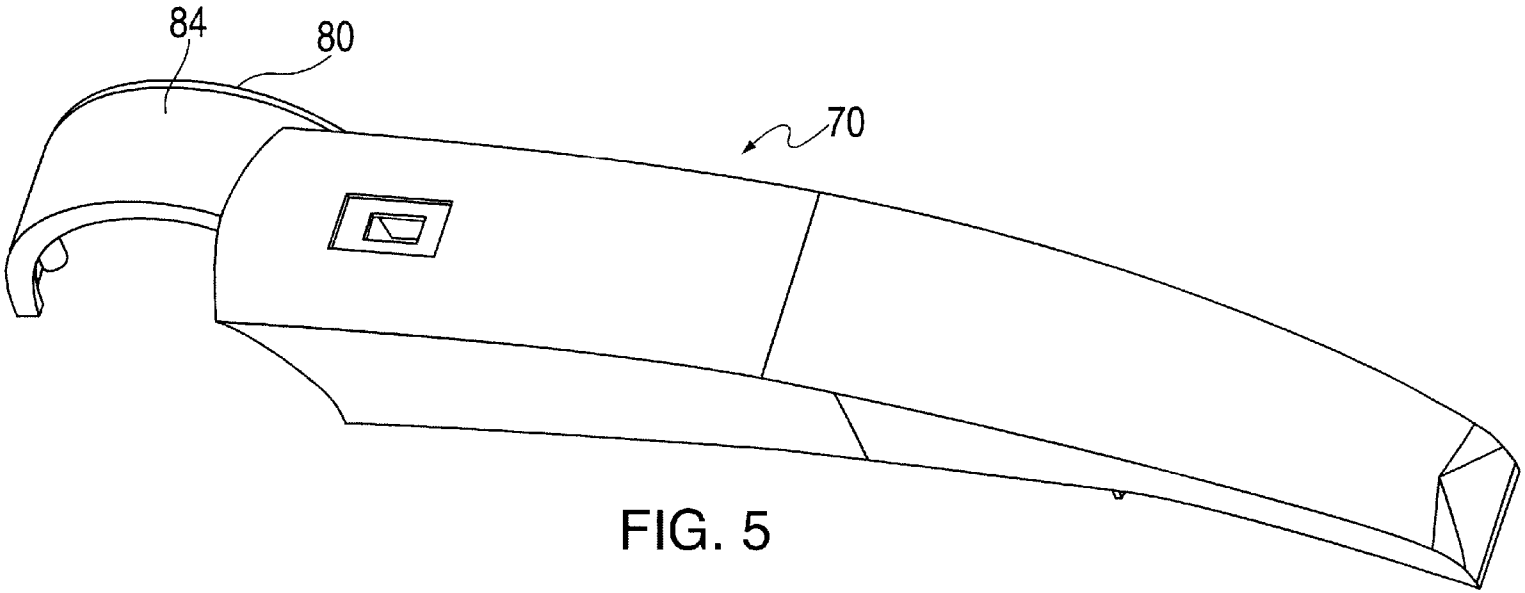
FIG. 5 is a top perspective view of a handle of said device.
Figure 8:
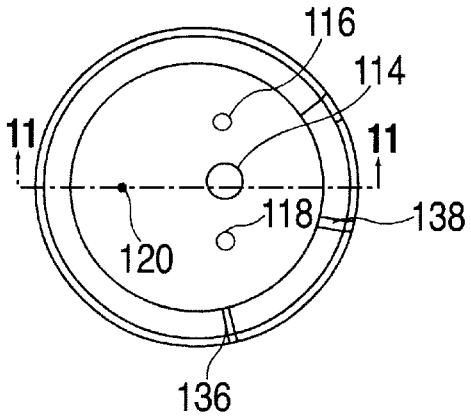
FIG. 8 is a top plan view of said rotatable cup.
Figure 6:
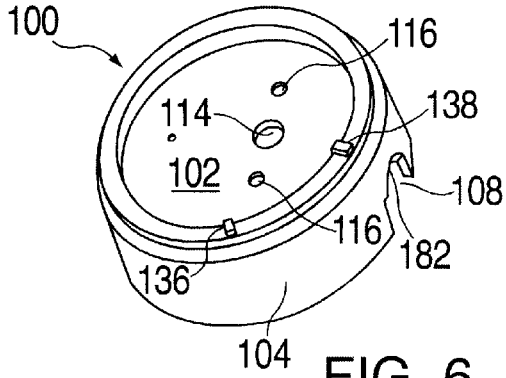
FIG. 6 is a top perspective view of the rotatable cup 100 of said device.
Figure 9:
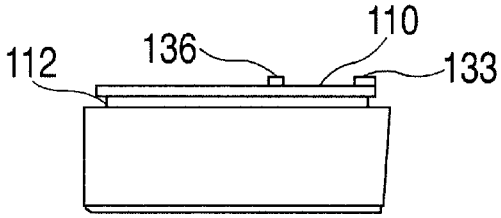
FIG. 9 is a side elevation view of said rotatable cup taken from the bottom of FIG. 8.
Figure 7:
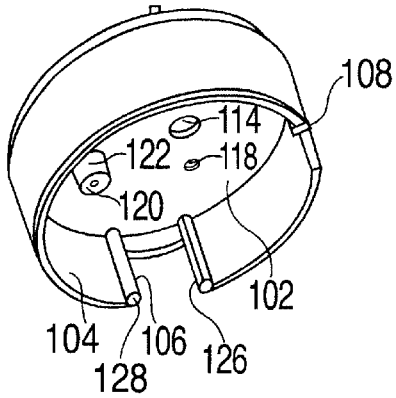
FIG. 7 is a bottom perspective view of the said rotatable cup.
Figure 10:
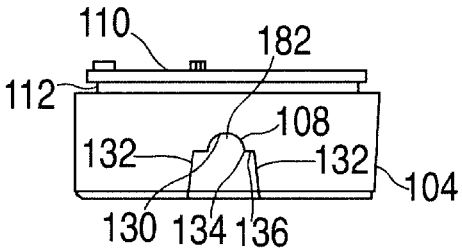
FIG. 10 is a side elevation view of said rotatable cup taken from the left of FIG. 8.
Figure 11:
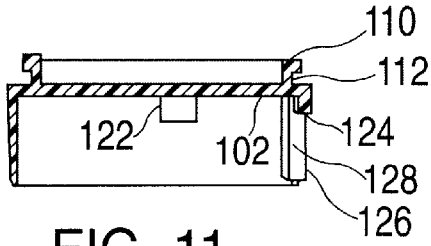
FIG. 11 is a side elevation view, in section, taken along the line 11—11 of FIG. 8 of said rotatable cup.
Figure 12:
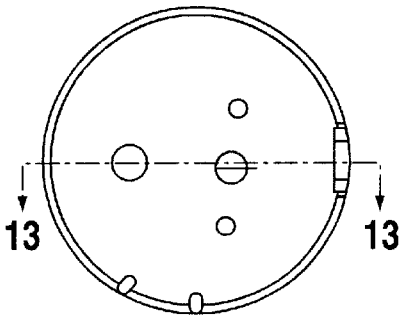
FIG. 12 is a top plan view, in horizontal section, of said rotatable cup.
Figure 13:
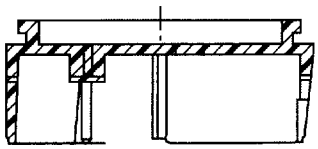
FIG. 13 is a side elevation view in vertical section taken along line 13—13 of FIG. 12.
Figure 14:
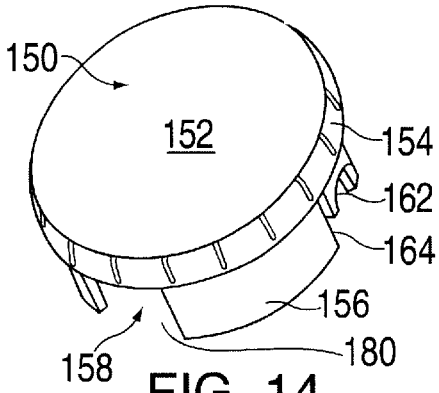
FIG. 14 is a top perspective view of the cover 150 of said device.
Figure 15:
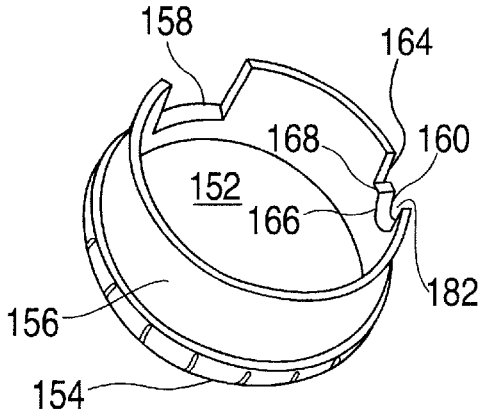
FIG. 15 is a bottom perspective view of said cover 150.
Figure 16:
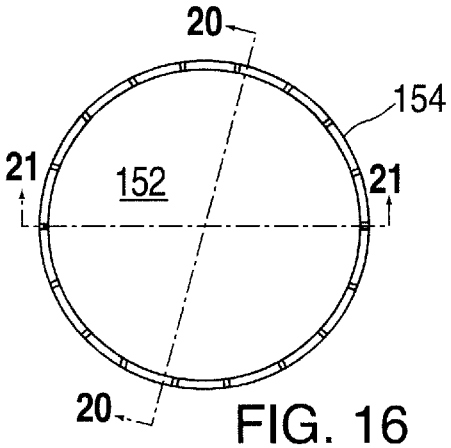
FIG. 16 is a top plan view of said cover.
Figure 17:
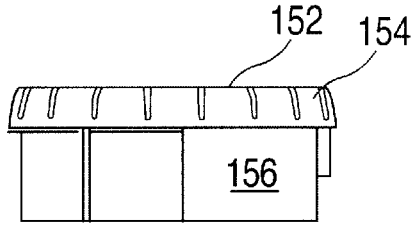
FIG. 17 is a side elevation view of said cover from the bottom of FIG. 16.
Figure 18:
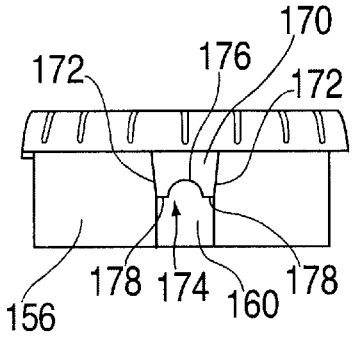
FIG. 18 is a side elevation view of said cover taken from the left of FIG. 16.
Figure 19:
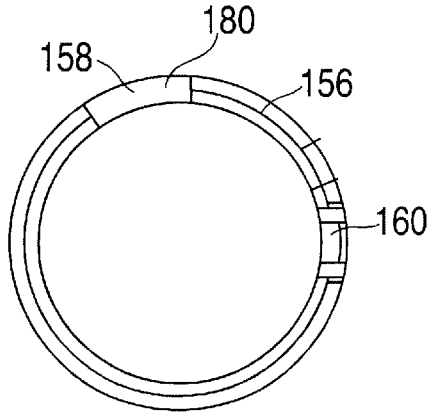
FIG. 19 is a top plan view, in horizontal section, of said cover.
Figure 20:
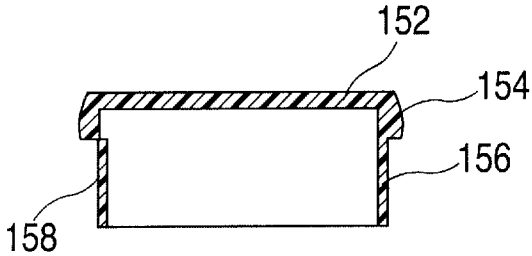
FIG. 20 is a side elevation view, in vertical section, taken along line 20—20 FIG. 16.
Figure 21:
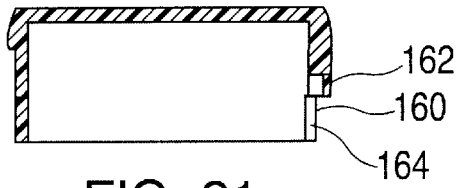
FIG. 21 is a side elevation view, in vertical section, taken along line 21—21 of FIG. 16.

As may be illustratively seen for FIGS. 1, 2, and 3, an amusement device of the present invention comprises an endless flexible loop 10 an and inline traction drive unit 20. The inline traction drive unit 20 positively drives the loop 10 generally in line with the longitudinal central axis of the loop 10. The unsupported portion of the endless flexible loop 10, when it is thusly driven, or "thrown" by the drive unit 20 assumes a configuration. The major portion of the loop 10 is disposed externally of the drive unit 20 and provides this configuration. Since there are changes in the interaction between the loop 10 and the drive unit 20 and in the behavior of the loop 10, this configuration changes or is variant about a mean configuration. As external forces act on driven loop 10, it assumes various configurations, such as is illustrated in phantom in FIG. 1. If these forces are dynamic, the loop configuration moves through a series of metastable configurations dynamically in concert with the dynamic forces affecting it, as will be discussed later.

The loop 10 comprises a highly flexible, limp, strand, or length, of fabric or filaments without ends and may, for example be formed by stitching or otherwise joining the ends of a length of woven string-like material. For example, the loop may be about 1575 millimeters in length and about 3.4 millimeters in diameter.

The loop 10 may be provided with indicia, such as a pattern or various colors, to provide an interesting or amusing visual effect. It could have luminescent or fluorescent, material added to provide a vivid visual effect.

The drive unit 20 comprises a handle 30 for gripping the drive unit and for changing its orientation, a drive motor 40, a pair of circumferentially-opposed drive wheels 50 and 60, and a housing 70.

Advantageously, the drive motor 40 may be a direct current electric motor capable of rotating at 8,800±10% revolutions per minute ("rpm") and providing a drive shaft 42 for driving one of the circumferentially-opposed wheels 50 and 60. It is powered by batteries B housed within the handle and actuated by a switch S that can be operated from the handle 30 by a user. Alternatively, the drive motor 40 may be a variable speed motor and/or be provided with a variable speed motor control (not shown).

As shown, the loop 10 is driven by friction resulting from the action of the circumferentially opposed wheels 50 and 60, which comprise a drive wheel 50 and a backup wheel 60 that are spaced from each other. The drive wheel 50 is mounted on the drive shaft 42 of the drive motor 40 and is directly driven by it. The drive wheel 50 comprises a base flange 52 and a removable top flange 54 with an intermediate hub 56. The hub 56 may be provided with a circumferential groove 58 for the driven loop 10 to ride in to orient and guide it and to increase the surface area of the hub 56 in contact with the loop 10. The backup wheel 60 is rotatably mounted on a shaft 62 and comprises a hub 64. The hub 64 is disposed vertically between, and spaced vertically from, removable top flange 54 and base flange 52. The base flange 52, intermediate hub 56 and removable top flange 54 of drive wheel 50, and the hub 64 of backup wheel 60, form a channel for trapping and guiding loop 10. The outer surface of each hub 56 and 64 is formed of a yieldable gripping material to aid in frictionally driving loop 10. The distance between the confronting surfaces of the two hubs 56 and 64 is slightly less than the nominal thickness or diameter of the loop 10 so that the confronting surfaces positively grip the loop 10 and drive it inline, that is along its length.

The housing 70 comprises a base 80 integrally extending from the handle 30, a rotatable cup 100 and a cover 150.

The base 80 comprises a circular base plate 82 and an upstanding cylindrical side wall 84 that encloses the electric motor 40 attached to the rotatable cup 100.

The rotatable cup 100 comprises circular base plate 102 and an upstanding cylindrical side wall 104 with a loop ejection hole 106 and a loop takeup hole 108, the two holes 106 and 108 being circumferentially-spaced from each other. The base plate 102 is provided with a depending cylindrical skirt 110 with a circumferential groove 112 in it. The electric motor 40 is mounted to the base plate 102 so that the shaft 42 passes through the plate 102 and projects into the cavity defined by the side wall 104 with the longitudinal central axis of the drive shaft 42 being in parallel relation to the axis of rotation of the rotatable cup 100. The drive shaft 42 passes through an aperture 114 which is radially spaced outwardly from the axis of rotation of the rotatable cup 100 so that the axis of rotation of the drive shaft 42 is radially offset from the axis of rotation of the cup 100. Attachment may be by a pair of fasteners passing through spaced apertures of 116 and 118 in the base plate 102. The drive wheel 50 is fixedly mounted to the drive shaft 42. The shaft 62 of the backup wheel 60 is fixedly mounted in an aperture 120 in an upstanding cylindrical boss 122 on the upper surface of the base plate 102. The axis of rotation of the backup wheel 60 is disposed in parallel relation to the axis of rotation of the drive wheel 50 and the axis of rotation of the rotatable cup 100. The ejection hole 106 comprises a bottom edge 124 spaced from the base plate 102 and a pair of opposed parallel side walls 126 , the edges of which comprise inwardly directed ribs 128 that are radiused or curved to provide a smooth surface against which the loop 10 may bear and ride in the event that it touches or bears against a side wall 126 during operation of the device 1. The ejection hole 106 is preferably open-ended to permit the loop to be removed from the device or reinstalled between the drive wheel 50 and the backup wheel 60. The takeup hole 108 comprises a bottom edge 130 spaced from the base plate and a pair of opposed diverging side walls. 32. The bottom edge 130 comprises a semicircular central portion 134 and a pair of straight portions 136 extending from the central portion 134 to the respective side walls 132. The outer edge of the central portion 134 is radiused or curved to provide a smooth surface against which the loop may bear and ride in the event that it touches against the central portion 134 during operation of the device 1. The cup 100 is rotatable with respect to the base 80 and handle 30 so as to change the orientation of the driven (or thrown) loop 10 and its configurations. The rotation of the cup 100 may be limited by a pair of circumferentially upstanding stop detents 136 and 138 that interact with an upstanding stop detent on the confronting interior wall of the base 80.

The cover 150 comprises a circular cap plate 152 provided with a grip portion 154 and a cylindrical side wall 156 provided with an ejection hole 158 and a takeup hole 160 that are circumferentially-spaced from each other and correspond to the two holes 106 and 108 in the side wall 104 of the rotatable cup 100. The outside diameter of the side wall 156 is slightly less than the inside diameter of the side wall 104 of the rotatable cup 100 so that there is a friction fit between the roatable cup 100 and the cover 150. The ejection hole 158 comprises a bottom edge 162 spaced from the base plate 152 and a pair of opposed parallel side walls 164. The ejection hole 158 is preferably open-ended to permit the loop 10 to be removed from the device 1 or reinstalled between the drive wheel 50 and the backup wheel 60 and to permit the cover 150 to be put in place with the loop 10 installed. The width of the ejection hole 106 is greater than the corresponding ejection hole of the rotatable cup 100 so that as the cover 150 is fitted onto the device 1 the side walls 164 of the ejection hole of the cover 150 are indexed by the side ribs 128 of the ejection hole 106 of the rotatable cup 100 and slide against them. The take up hole 160 comprises a bottom edge 162 spaced from the cap plate and a pair of opposed parallel side walls 164. The bottom edge 162 comprises a semicircular central portion 166 and a pair of straight portions 168 extending from the central portion 166 to the respective side walls. The outer edge of the central portion 166 is radiused or curved to provide a smooth surface against which the loop 10 may bear and ride in the event that it touches or bears against the central portion 166 during operation of the device 1. A depending boss 170 extends from the grip portion 154 to the bottom edge and comprises a pair of opposed converging side edges 172 that are formed in complement to the diverging side walls 132 of the takeup hole 108 of the rotatable cup 100 and a bottom edge 174 with a semicircular central portion 170 and a pair of straight portions 178 extending from the central portion 176 to intersect with the respective side edges 172 of the boss 170. The convergent side edges 172 of the boss 170 of the cover 150 and the divergent side walls 132 of the takeup hole 108 of the rotatable cup 100 serve to index the cover 150 with respect to the rotatable cup 100 and to guide them into closure.

When the cover 150 is in place in the rotatable cup 100, the ejection hole 106 of the rotatable cup 100 and the ejection hole 158 of the cover 150 preferably define a rectangular-shaped ejection aperture 180 through which the driven loop 10 exits from the inline traction drive unit 20. Similarly, when the cover 150 is in place in the rotatable cup 100, the takeup hole 108 of the rotatable cup 100 and the takeup hole of 160 the cap preferably define a circular-shaped takeup aperture 182 through which the loop 10 returns to the inline traction drive unit 20. The takeup aperture 182 is vertically aligned with the circumferential groove 58. The diameter of takeup aperture 182 may be, preferably, about 7 millimeters. The rectangular-shaped ejection aperture 180 and the circular-shaped takeup aperture 182 (and their corresponding holes) are circumferentially spaced from each other from about 105 degrees to about 110 degrees.

The cover 150, in conjunction with the rotatable cup 100, permits the rotatable cup 100 to be rotated so that the orientation of the driven loop 10, ejection aperture 180 and takeup aperture 182 are rotationally changed to effect changes in the configuration of the driven loop 10. The rotation may be about 45 degrees. Similarly, the orientation of the handle 30 can be changed, thereby changing the configuration assumed by the driven loop 10.

Advantageously, motor 40 has a cut off means, such as an electronic circuit, (not shown) to stop rotation of wheels 50 and 60 if loop 10 becomes entangled or some interference occurs, which creates stress on wheels 50 and 60 rotating freely. A slip clutch may also be used if a stoppage of the loop occurs.

In operation, the loop 10 is supported by the side ribs 128 of the ejection aperture 180, the drive wheel 50, the backup wheel 60 or the takeup aperture 182, depending on the orientation of the device 1, before the drive unit 20 is actuated. Upon actuation, the drive wheel 50 rotates, in turn driving the loop 10 in line and in cooperation with the backup wheel 60. The thus-driven loop 10 is ejected from the inline traction drive unit 20 through the ejection aperture 180. The driven or thrown loop 10 is ejected from the drive wheel 50 and the backup wheel 60 at an angle to the line passing through the axis of rotation of drive wheel 50 and the backup wheel 60. Upon exiting the unit 20, the ejected portion of the driven loop 10 assumes a gently parabolic trajectory and is then free to be subjected to the forces that may be applied to it by, and in, the ambient environment.

The free length of loop 10 flows, generally, in a vertical general plane when the longitudinal axis of rotation of drive wheel 50 is horizontally oriented and flows generally, in a horizontal general plane when that axis is vertically oriented. The speed of ejection of the loop through aperture 180 causes the loop to extend outward to the extent of the free length of loop 10 and the free length of the loop 10 assumes an ovoid configuation. Any movement of the drive unit 20 causes the exposed portion loop 10 to change shape. (For example) If a portion of the free length of the loop 10 touches a surface, the loop 10 will change its configuration. The speed of the loop 10 at ejection from wheels 50 and 60 is determined by the rotational speed of the outer periphery of the drive wheel 50 and the diameter of hub 56, between which the loop strand passes. The minimum linear speed of the loop 10 at this ejection is about fifteen feet per second (preferably about twenty feet per second minimum), although the desired speed can be varied and is affected by the linear density of the material of the loop 10, its transverse diameter, and its weight. The preferred linear speed of the loop 10 at ejection may be about 28 feet per second.

Optionally, the device includes a stand 200 (FIGS. 1 and 2) for supporting the drive unit in a fixed orientation and to store the drive unit 10.

While the device 1 has been described as being portable, it should be understood that it can be mounted in a stand and/or fixed in position. Further, while the device 1 has been described as being battery operated, it may also be powered by line current from a wall outlet such as by a power cord.

Although certain features of the invention have been illustrated and described herein, other better modifications and changes will occur to those skilled in the art. It is, therefore, to be understood that the appended claims are intended to cover all such modifications and changes that fall within the spirit of the invention.

I claim:

1. An amusement device comprising:

a. a housing;

b. a traction drive unit contained within said housing, said traction drive unit comprises a pair of wheels, at least one of which is driven, said wheels lying substantially in a common plane with corresponding circumferences at one point oppositely facing at a predetermined distance apart;

c. a flexible strand in the form of an endless loop having a portion within said housing and a major portion of said loop being unsupported and disposed externally of said housing, said strand passing between said wheels at said one point, whereby a portion of said strand being positively engaged by said traction drive unit within said housing for imparting linear velocity to said strand, so that said strand is driven in motion along its length at a speed to cause the external unsupported portion of the loop to extend to its full length and form varying loop configurations.

2. An amusement device as recited in claim 1, wherein said traction drive unit includes a handle for changing the orientation of the drive unit.

3. An amusement device as recited in claim 2, wherein said pair of wheels comprises a drive wheel and a backup wheel.

4. An amusement device as recited in claim 3, wherein said drive unit comprises a drive motor in operative association with said drive wheel.

5. An amusement device as recited in claim 3, wherein said loop is disposed between said drive wheel and said backup wheel in driven association with said drive wheel.

6. An amusement device as recited in claim 1, wherein said device is portable.

7. An amusement device as recited in claim 1, wherein said traction drive unit positively grips said strand.

8. An amusement device as recited in claim 1, wherein said major portion of said strand is free to be subjected to forces that may be applied to it by, and in, the ambient environment.

9. An amusement device as recited in claim 1, wherein said major portion of said strand is free to be subjected to external forces acting on said loop and assumes various configurations.

10. An amusement device as recited in claim 1, wherein said major portion of said strand is free to be subjected to external dynamic forces acting on said loop and the configuration of said loop moves through a series of configurations.

11. An amusement device as recited in claim 1, wherein said housing is removably mounted on a stand.

12. An amusement device as recited in claim 1, wherein said drive unit is portable and may be operated while hand cared by the user.

13. An amusement device comprising:

a. a flexible strand having a longitudinal axis, said strand forming an endless loop;

b. a housing comprises an ejection aperture through which said loop may be ejected from said housing; and c. an inline traction drive unit contained in said housing positively engaging a portion of said strand for imparting inline linear velocity along the longitudinal axis of the strand so that said strand is driven in motion along its length, a major portion of said loop being unsupported and disposed externally of said drive unit and said housing to form varying loop configurations as it is driven in motion, said traction drive unit includes a handle for changing the orientation of the drive unit, said traction drive comprises a drive wheel and a backup wheel circumferentially opposed to each other for driving said loop.

14. An amusement device as recited in claim 13, wherein said housing comprises a take-up aperture through which said loop may return to said pair of wheels.

* * * * *